US010727596B2

(12) United States Patent
Quinlan et al.

(10) Patent No.: US 10,727,596 B2
(45) Date of Patent: Jul. 28, 2020

(54) ANTENNA STRUCTURE

(71) Applicant: TAOGLAS LIMITED, Taoyuan (TW)

(72) Inventors: Ronan Quinlan, Taoyuan (TW); Wen-Chieh Yang, Taoyuan (TW); Ming-Wei Chen, Taoyuan (TW)

(73) Assignee: Taoglas Limited, Taoyuan (TW)

( * ) Notice: Subject to any disclaimer, the term of this patent is extended or adjusted under 35 U.S.C. 154(b) by 0 days.

(21) Appl. No.: 15/990,347

(22) Filed: May 25, 2018

(65) Prior Publication Data

US 2018/0342808 A1 Nov. 29, 2018

(30) Foreign Application Priority Data

May 26, 2017 (TW) ..... 106117543 A

(51) Int. Cl.

| | |
|---|---|
| ***H01Q 9/04*** | (2006.01) |
| ***H01Q 9/42*** | (2006.01) |
| ***H01Q 5/371*** | (2015.01) |
| ***H01Q 1/24*** | (2006.01) |

(52) U.S. Cl.

CPC ..... *H01Q 9/0421* (2013.01); *H01Q 1/243* (2013.01); *H01Q 5/371* (2015.01); *H01Q 9/045* (2013.01); *H01Q 9/42* (2013.01)

(58) Field of Classification Search

CPC ..... H01Q 9/0421; H01Q 5/371; H01Q 1/243; H01Q 9/045; H01Q 9/42

See application file for complete search history.

(56) References Cited

U.S. PATENT DOCUMENTS

| | | | | |
|---|---|---|---|---|
| 2009/0027277 A1* | 1/2009 | Su | ..... | H01Q 1/2258 343/700 MS |
| 2013/0033399 A1* | 2/2013 | Huang | ..... | H01Q 9/0421 343/700 MS |
| 2013/0229318 A1* | 9/2013 | Ng | ..... | H01Q 9/0421 343/770 |

* cited by examiner

*Primary Examiner* — Dameon E Levi
*Assistant Examiner* — David E Lotter
(74) *Attorney, Agent, or Firm* — Knobbe, Martens, Olson & Bear, LLP

(57) ABSTRACT

An antenna structure (10) includes an antenna feed-in element (1), a first antenna trace element (2), a second antenna trace element (3), a supporting element (4), a grounded-short-circuit element (5), a third antenna trace element (6) and a fourth antenna trace element (7). The first antenna trace element (2), the second antenna trace element (3), the third antenna trace element (6) and the fourth antenna trace element (7) which have vertical segments in different lengths form a multi-trace planar inverted-F antenna to obtain the best bandwidth covering the full band, so that the height of the antenna structure (10) is lower, the length is shorter and the structure is denser. The impedance matching of the antenna structure (10) is controlled easily. No external matching element is required. With the multi-trace and grounded-short-circuit design of the antenna structure (10), the better resonance in the LTE full band is obtained.

20 Claims, 3 Drawing Sheets

ANTENNA STRUCTURE

BACKGROUND OF THE INVENTION

Field of the Invention

The present invention relates to an antenna, and especially relates to a planar inverted-F antenna (PIFA) structure having the ultra-wide band long term evolution (LTE) technology.

Description of the Related Art

The long term evolution (LTE) technology is a high speed wireless communication standard for the mobile phone and data terminal in the telecommunication. The standard is based on the previous GSM/EDGE and UMTS/HSPA network technology, and uses the modulation technology to increase the network capacity and speed.

Currently, there are many types of LTE antennas. Some LTE antenna structures are manufactured with metal sheets which are pressed (or punched) and then bended. Some LTE antenna structures are manufactured by printing the pattern layer of the antenna on the circuit board directly, and then the antenna pattern is manufactured by the etching technology. Moreover, some LTE antenna structures are manufactured with the radiation metal lines which are manufactured on the ceramic chips, and then the ceramic chips are electrically connected to the circuit board which comprises the feed-in lines and the grounded layer to form the LTE antenna structures. Although the LTE antenna structures mentioned above can achieve the predetermined communication effect, the volumes of the LTE antenna structures are large, the impedance matching of the LTE antenna structures themselves are not controlled easily, and the external matching elements are required to adjust the impedance matching, so that manufacturing the antenna structures is difficult and not easy.

SUMMARY OF THE INVENTION

Therefore, the main object of the present invention is that the present invention re-designs the LTE antenna structure. Utilizing vertical segments in different lengths designs the multi-trace planar inverted-F antenna. Besides obtaining the best bandwidth covering the full band, the height of the antenna structure is lower, the length is shorter and the structure is denser. The impedance matching of the antenna structure can be controlled by the designer. No external matching element is required. With the multi-trace and grounded-short-circuit design of the antenna structure, the better resonance in the LTE full band is obtained.

In order to achieve the object mentioned above, the present invention provides an antenna structure comprising an antenna feed-in element, a first antenna trace element, a second antenna trace element, a supporting element, a grounded-short-circuit element, a third antenna trace element and a fourth antenna trace element. The antenna feed-in element is a square plate or sheet. The first antenna trace element is a square plate or sheet connected to one side of the antenna feed-in element and is oblique with a specific angle (namely, a first angle). The second antenna trace element is a square plate or sheet connected to another side of the antenna feed-in element and is oblique with a specific angle (namely, a second angle), wherein the first angle is different from the second angle, or the first angle is the same with (namely, equal to) the second angle. A direction of the first antenna trace element is different from a direction of the second antenna trace element, so that the first antenna trace element and the second antenna trace element form an opening. The supporting element is a square plate or sheet connected to another side of the antenna feed-in element and is connected to the antenna feed-in element vertically. The grounded-short-circuit element is a plate or sheet connected to one side of the supporting element and is connected to the supporting element vertically. The third antenna trace element is connected to another side of the supporting element, is connected to the supporting element vertically and is arranged correspondingly to the grounded-short-circuit element. The fourth antenna trace element comprises one side connected to one side of the grounded-short-circuit element (or the fourth antenna trace element is connected to one side of the grounded-short-circuit element), so that the fourth antenna trace element is arranged correspondingly to the grounded-short-circuit element.

In an embodiment of the present invention, the antenna feed-in element comprises a first gap, a first protruding part, a second gap and a second protruding part. The first gap is arranged at one side of the antenna feed-in element and is in an L shape. The first protruding part is arranged above the first gap. The second gap is arranged at another side of the antenna feed-in element. The second protruding part is arranged above the second gap. Another side of the antenna feed-in element is electrically connected to a circuit board or a cable.

In an embodiment of the present invention, a length of the first gap is longer than a length of the second gap.

In an embodiment of the present invention, the first antenna trace element is connected to the first protruding part.

In an embodiment of the present invention, a width of the first antenna trace element is equal to a length of the first protruding part.

In an embodiment of the present invention, the second antenna trace element is connected to the second protruding part.

In an embodiment of the present invention, a width of the second antenna trace element is equal to a length of the second protruding part.

In an embodiment of the present invention, the opening is gradually reduced inwardly.

In an embodiment of the present invention, the supporting element comprises a third gap and a third protruding part. The third gap and the third protruding part are arranged at one side of the supporting element.

In an embodiment of the present invention, the grounded-short-circuit element is connected to the third protruding part which is arranged at one side of the supporting element.

In an embodiment of the present invention, the grounded-short-circuit element comprises a broadside which is in a stair-step shape and is arranged at one side of the grounded-short-circuit element. The broadside of the grounded-short-circuit element is electrically connected to a circuit board.

In an embodiment of the present invention, the fourth antenna trace element comprises a first sheet, a second sheet and a third sheet. The first sheet is connected to the broadside of the grounded-short-circuit element and is connected to the grounded-short-circuit element vertically.

One side of the first sheet is connected to the second sheet. The second sheet is vertically connected to the first sheet. One side of the second sheet is connected to the third sheet. The third sheet is in a number 7 shape and is arranged correspondingly to the grounded-short-circuit element.

In an embodiment of the present invention, the first sheet and the second sheet are square plates or sheets.

In an embodiment of the present invention, the third antenna trace element is a U-shaped plate or sheets.

DETAILED DESCRIPTION OF THE INVENTION

Figure 1:
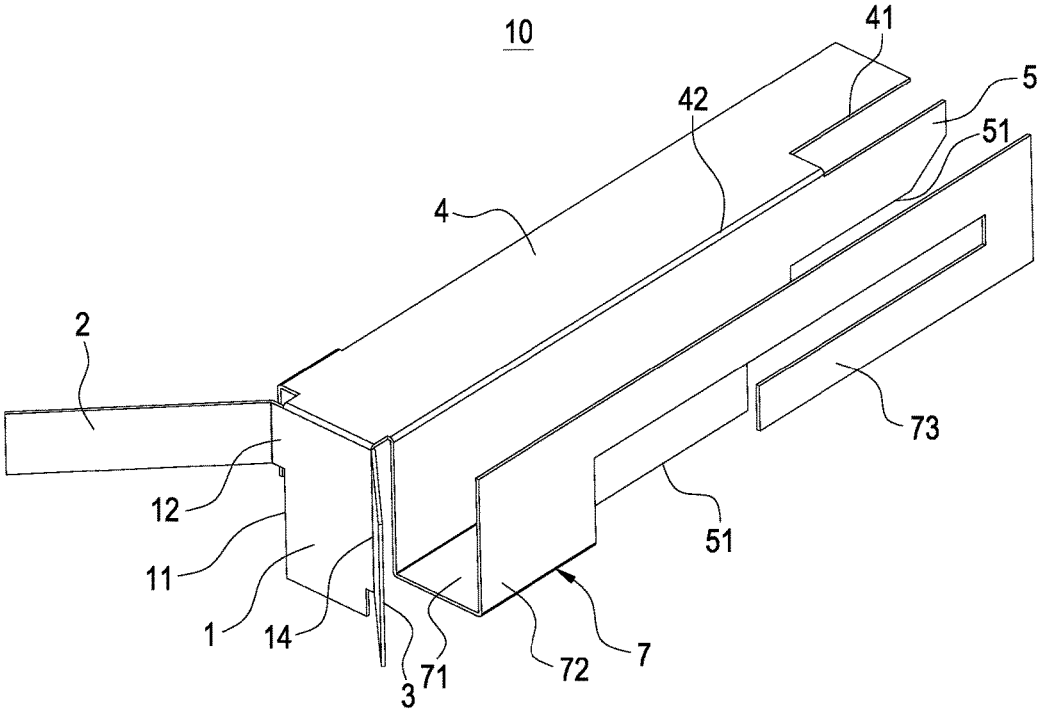
FIG. 1 shows a schematic diagram of the front view of the antenna structure of the present invention.
Figure 2:
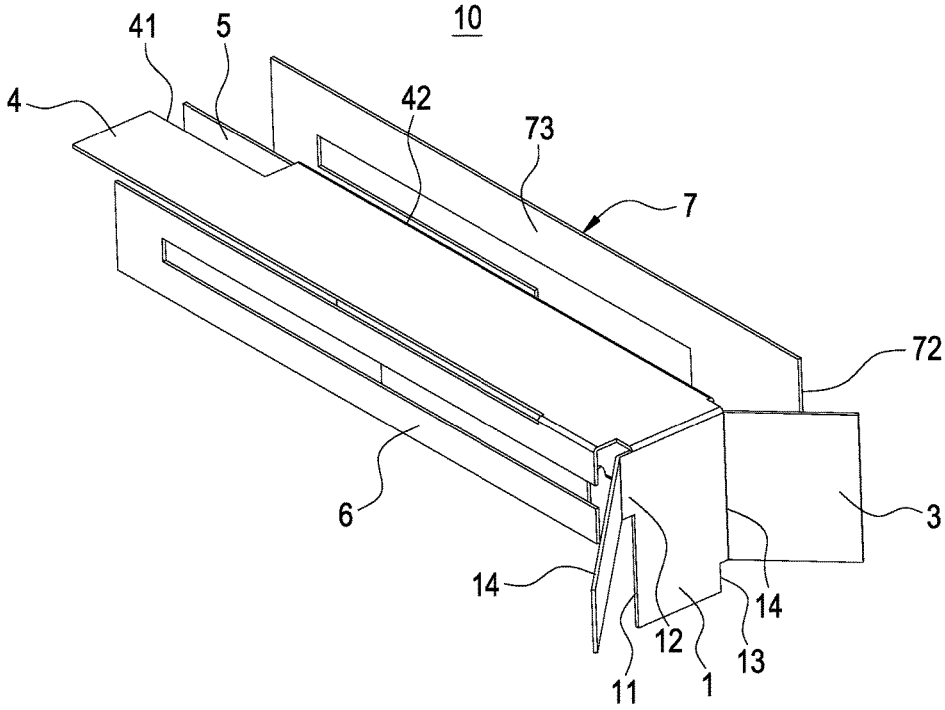
FIG. 2 shows a schematic diagram of the back view of the antenna structure of the present invention.
Figure 3:
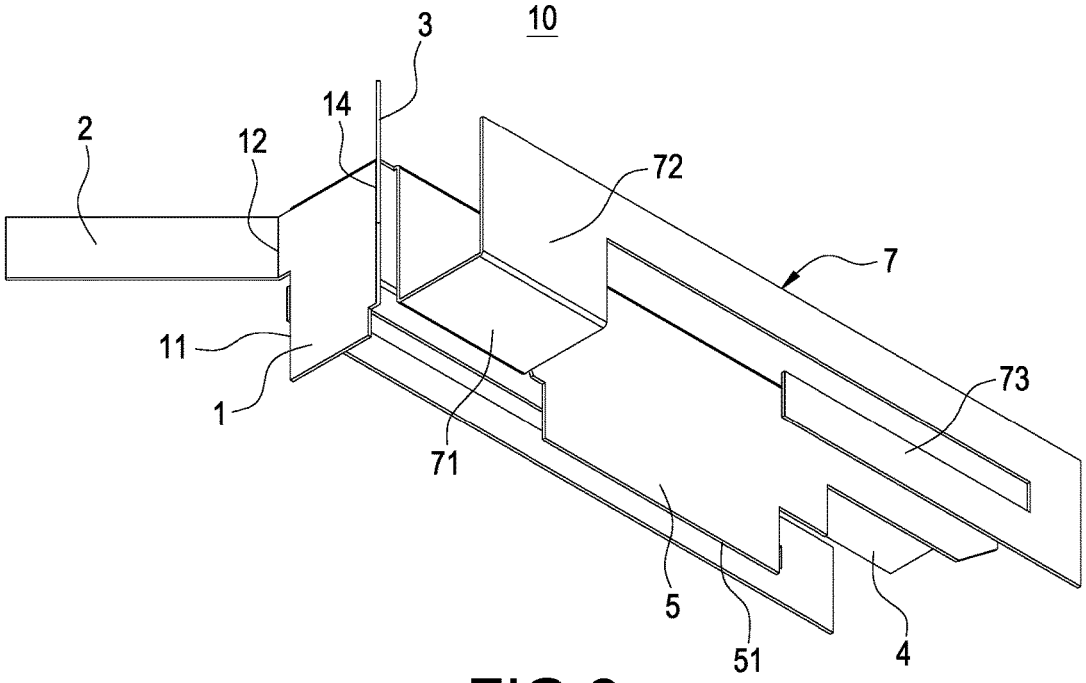
FIG. 3 shows a schematic diagram of the front looking-up view of the antenna structure of the present invention.
Figure 4:
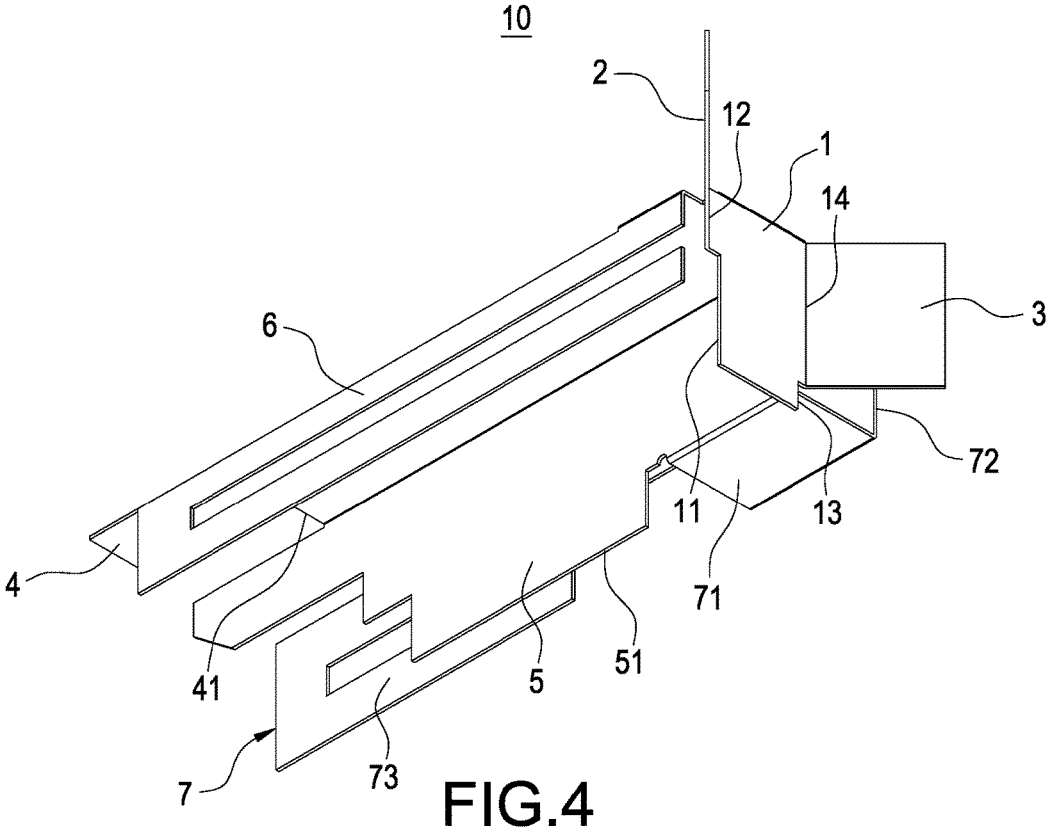
FIG. 4 shows a schematic diagram of the back looking-up view of the antenna structure of the present invention.

Now please refer to following detailed description and figures for the technical content of the present invention:

FIG. 1 shows a schematic diagram of the front view of the antenna structure of the present invention. FIG. 2 shows a schematic diagram of the back view of the antenna structure of the present invention. FIG. 3 shows a schematic diagram of the front looking-up view of the antenna structure of the present invention. FIG. 4 shows a schematic diagram of the back looking-up view of the antenna structure of the present invention. As shown in FIGS. 1~4, an antenna structure 10 of the present invention is manufactured with a metal sheet (or metal sheets) pressed and bended. The antenna structure 10 comprises an antenna feed-in element 1, a first antenna trace element 2, a second antenna trace element 3, a supporting element 4, a grounded-short-circuit element 5, a third antenna trace element 6 and a fourth antenna trace element 7. The antenna structure 10 is applied to the band between 700 MHZ~5 GHZ, and is a multi-trace full band LTE antenna structure.

The antenna feed-in element 1 is a square plate or sheet. The antenna feed-in element 1 comprises a first gap 11, a first protruding part 12, a second gap 13 and a second protruding part 14. The first gap 11 is arranged at one side of the antenna feed-in element 1 and is in an L shape. The first protruding part 12 is arranged above the first gap 11. The second gap 13 is arranged at another side of the antenna feed-in element 1. The second protruding part 14 is arranged (or formed) above the second gap 13. Moreover, a length of the first gap 11 is longer than a length of the second gap 13. Another side of the antenna feed-in element 1 is electrically connected to a circuit board (not shown in FIGS. 1~4) or a cable (not shown in FIGS. 1~4).

The first antenna trace element 2 is a square plate or sheet connected to the first protruding part 12 and is oblique with a specific angle (namely, a first angle). A width of the first antenna trace element 2 is equal to a length of the first protruding part 12.

The second antenna trace element 3 is a square plate or sheet connected to the second protruding part 14 and is oblique with a specific angle (namely, a second angle), wherein the first angle is different from the second angle, or the first angle is the same with (namely, equal to) the second angle. A direction of the first antenna trace element 2 is different from a direction of the second antenna trace element 3, so that the first antenna trace element 2 and the second antenna trace element 3 form an opening which is gradually reduced inwardly, such as a bell mouth, a horn mouth or a trumpet mouth. A width of the second antenna trace element 3 is equal to a length of the second protruding part 11.

The supporting element 4 is a square plate or sheet connected to another side of the antenna feed-in element 1 and is connected to the antenna feed-in element 1 vertically. The supporting element 4 comprises a third gap 41 and a third protruding part 42. The third gap 41 and the third protruding part 42 are arranged at one side of the supporting element 4.

The grounded-short-circuit element 5 is a plate or sheet connected to the third protruding part 42 which is arranged at one side of the supporting element 4. The grounded-short-circuit element 5 is connected to the supporting element 4 vertically. The grounded-short-circuit element 5 comprises a broadside 51 which is in a stair-step shape and is arranged at one side of the grounded-short-circuit element 5. The grounded-short-circuit element 5 is electrically connected to a circuit board (not shown in FIGS. 1~4) through the broadside 51.

The third antenna trace element 6 is connected to another side of the supporting element 4, is connected to the supporting element 4 vertically and is arranged correspondingly to the grounded-short-circuit element 5. In FIGS. 1~4, the third antenna trace element 6 is a U-shaped plate or sheet.

The fourth antenna trace element 7 comprises a first sheet 71, a second sheet 72 and a third sheet 73. The first sheet 71 is connected to the broadside 51 of the grounded-short-circuit element 5 and is connected to the grounded-short-circuit element 5 vertically. One side of the first sheet 71 is connected to the second sheet 72. The second sheet 72 is vertically connected to the first sheet 71. One side of the second sheet 72 is connected to the third sheet 73. The third sheet 73 is in a number 7 shape and is arranged correspondingly to the grounded-short-circuit element 5. In FIGS. 1~4, the first sheet 71 and the second sheet 72 are square plates or sheets.

According to the antenna structure 10 mentioned above using vertical segments in different lengths to design the multi-trace planar inverted-F antenna, besides obtaining the best bandwidth covering the full band, the height of the antenna structure 10 is lower, the length is shorter and the structure is denser. The impedance matching of the antenna structure 10 can be controlled by the designer. No external matching element is required. With the multi-trace and grounded-short-circuit design of the antenna structure 10, the better resonance in the LTE full band is obtained.

Figure 5:
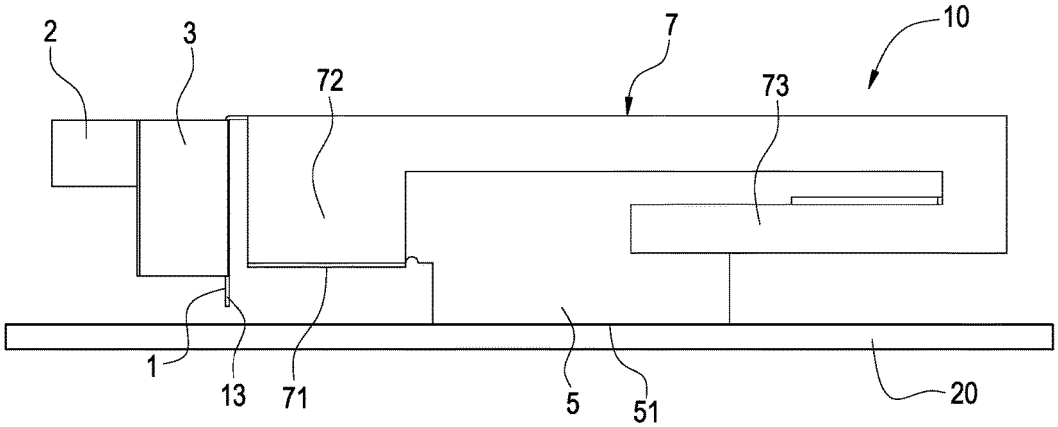
FIG. 5 shows an electrical connection diagram of the antenna structure and the circuit board of the present invention.

FIG. 5 shows an electrical connection diagram of the antenna structure and the circuit board of the present invention. As shown in FIG. 5, when the antenna structure 10 of the present invention is electrically connected to a circuit board 20, the antenna feed-in element 1 and the grounded-short-circuit element 5 of the antenna structure 10 are utilized to be electrically connected to the circuit board 20. When the first antenna trace element 2, the second antenna trace element 3, the third antenna trace element 6 and the fourth antenna trace element 7 of the antenna structure 10 receive or transmit signals respectively, the signals are transmitted to the circuit board 20 through the antenna feed-in element 1.

When the antenna structure 10 communicates, a band used by the first antenna trace element 2 is between 1710 MHZ~2690 MHZ, a band used by the second antenna trace element 3 is 5 GHZ, a band used by the third antenna trace element 6 is 700 MHZ which is a low band and a band used by the fourth antenna trace element 7 is 960 MHZ which is a low band.

Therefore, the antenna structure 10 is designed as a planar inverted-F antenna which is extended from the grounded plane in parallel and is consist of the monopole antenna, wherein one side of the monopole antenna is connected to the ground. The antenna structure 10 feeds through a middle point (the antenna feed-in element 1) which is at a certain distance from the grounded side (the grounded-short-circuit element 5). The antenna structure 10 using the vertical segments in different lengths to design the multi-trace planar inverted-F antenna comprises several advantages as following. The height of the antenna structure 10 is lower, the length is shorter and the antenna structure 10 is denser. The impedance matching can be controlled by the designer. No external matching element is required.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An antenna structure comprising:

a planar antenna feed-in element;

a first planar antenna trace element connected to a first side of the antenna feed-in element and oriented at a first oblique angle to the planar antenna feed-in element;

a second planar antenna trace element connected to a second side of the planar antenna feed-in element oriented at a second oblique angle to the planar antenna feed-in element, the first planar antenna trace element oriented in a direction different from a direction in which the second planar antenna trace element is oriented so that the first planar antenna trace element and the second planar antenna trace element form an opening;

a planar supporting element connected at a first side of the planar supporting element to a third side of the planar antenna feed-in element;

a planar grounded-short-circuit element connected at a first side to a second side of the planar supporting element;

a third antenna trace element connected to a third side of the planar supporting element; and a fourth antenna trace element connected at a first side connected to a second side of the grounded-short-circuit element.

2. The antenna structure of claim 1, wherein the planar antenna feed-in element comprises:

a first gap, the first gap arranged at one side of the planar antenna feed-in element, the first gap having an L-shape;

a first protruding part arranged above the first gap;

a second gap arranged at another side of the planar antenna feed in element; and a second protruding part arranged above the second gap; and wherein another side of the planar antenna feed-in element is electrically connected to at least one of a circuit board and a cable.

3. The antenna structure of claim 2, wherein a length of the first gap is longer than a length of the second gap.

4. The antenna structure of claim 2, wherein the first planar antenna trace element is connected to the first protruding part.

5. The antenna structure of claim 4, wherein a width of the first planar antenna trace element is equal to a length of the first protruding part.

6. The antenna structure of claim 2, wherein the second planar antenna trace element is connected to the second protruding part.

7. The antenna structure of claim 6, wherein a width of the second planar antenna trace element is equal to a length of the second protruding part.

8. The antenna structure of claim 1, wherein the opening tapers inward in the direction of the planar antenna feed-in element.

9. The antenna structure of claim 1, wherein the planar supporting element comprises a third gap and a third protruding part, and wherein the third gap and the third protruding part are arranged at one side of the supporting element.

10. The antenna structure of claim 9, wherein the grounded-short-circuit element is connected to the third protruding part arranged at one side of the planar supporting element.

11. The antenna structure of claim 10, wherein the grounded- short-circuit element comprises a broadside arranged at one side of the grounded-short-circuit element and electrically connected to a circuit board, the broadside comprising a stair-step shape.

12. The antenna structure of claim 11, wherein the fourth antenna trace element comprises:

a first sheet connected to the broadside of the grounded-short-circuit element;

a second sheet, wherein one side of the first sheet is connected to the second; and a third sheet, wherein one side of the second sheet is connected to the third sheet and wherein the third sheet is in a number 7 shape.

13. The antenna structure of claim 12, wherein the first sheet and the second sheet comprise rectangular plates.

14. The antenna structure of claim 1, wherein the third antenna trace element comprises a U-shaped plate.

15. An antenna comprising:

an antenna feed-in element;

a first antenna trace element connected to a first edge of the antenna feed-in element and oriented at a first oblique angle to the antenna feed-in element;

a second antenna trace element connected to a second edge of the antenna feed-in element and oriented at a second oblique angle to the antenna feed-in element, the first edge of the antenna feed-in element located opposite the second edge of the antenna feed-in element;

a supporting element connected at a first edge of the supporting element to a third edge of the antenna feed-in element;

a grounded short circuit element connected at a first edge to a second edge of the supporting element;

a third antenna trace element connected to a third edge of the supporting element;

and a fourth antenna trace element connected at a first edge connected to a second edge of the grounded short circuit element.

16. The antenna of claim 15, wherein the supporting element is generally orthogonal to the antenna feed-in element.

17. The antenna of claim 15, wherein the grounded short circuit element is generally parallel to the third antenna trace element.

18. The antenna of claim 15, wherein a first portion of the fourth antenna trace element is generally orthogonal to the grounded short circuit element.

19. The antenna of claim 18, wherein a second portion of the fourth antenna trace element is generally parallel to the grounded short circuit element.

20. The antenna of claim 18, wherein the size of the first oblique angle is substantially equal to the size of the second oblique angle.

* * * * *